US009329537B2

(12) United States Patent
Ishida

(10) Patent No.: US 9,329,537 B2
(45) Date of Patent: May 3, 2016

(54) FIXING DEVICE PROVIDED WITH FRAME MOVABLY SUPPORTING HEATING ASSEMBLY

(71) Applicant: Brother Kogyo Kabushiki Kaisha, Nagoya-shi, Aichi-ken (JP)

(72) Inventor: Kei Ishida, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/141,727

(22) Filed: Dec. 27, 2013

(65) Prior Publication Data

US 2014/0186074 A1 Jul. 3, 2014

(30) Foreign Application Priority Data

Dec. 28, 2012 (JP) ..... 2012-288266

(51) Int. Cl.
*G03G 15/20* (2006.01)

(52) U.S. Cl.
CPC ..... *G03G 15/2032* (2013.01); *G03G 15/2053* (2013.01); *G03G 15/2064* (2013.01); *G03G 2215/2035* (2013.01)

(58) Field of Classification Search
CPC ..... G03G 15/2032; G03G 15/2017; G03G 15/2067
See application file for complete search history.

(56) References Cited

U.S. PATENT DOCUMENTS

| | | | | |
|---|---|---|---|---|
| 5,729,798 | A * | 3/1998 | Yasui et al. | 399/122 |
| 6,618,574 | B2 * | 9/2003 | Nishitani | 399/329 |
| 2002/0028089 | A1 * | 3/2002 | Yoneda et al. | 399/122 |
| 2002/0127034 | A1 | 9/2002 | Nishitani | |
| 2006/0133868 | A1 * | 6/2006 | Kobayashi | G03G 21/1685 399/328 |
| 2011/0170920 | A1 * | 7/2011 | Fujiwara et al. | 399/331 |

FOREIGN PATENT DOCUMENTS

JP 2002-268412 A 9/2002

* cited by examiner

*Primary Examiner* — David Gray
*Assistant Examiner* — Michael Harrison
(74) *Attorney, Agent, or Firm* — Banner & Witcoff, Ltd.

(57) ABSTRACT

A fixing device may include: a roller; a heating assembly; a pressing assembly; and a frame. The heating assembly may include a guided portion having first and second surfaces. The frame may movably support the heating assembly. The frame may include: a recessed portion; first and second guide portions. The first and second guide portions may guide movement of the heating assembly. The guided portion may be interposed between the first and second guide portions. The first guide portion may have a first restriction surface facing the first surface to restrict the guided portion from moving. The second guide portion may have a second restriction surface facing the second surface to restrict the guided portion from moving. Farthest end portions of the first and second restriction surfaces to the roller may face the first and second surfaces respectively when the heating assembly is in its closest position to the roller.

17 Claims, 8 Drawing Sheets

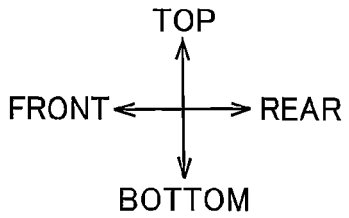
FIG.8A
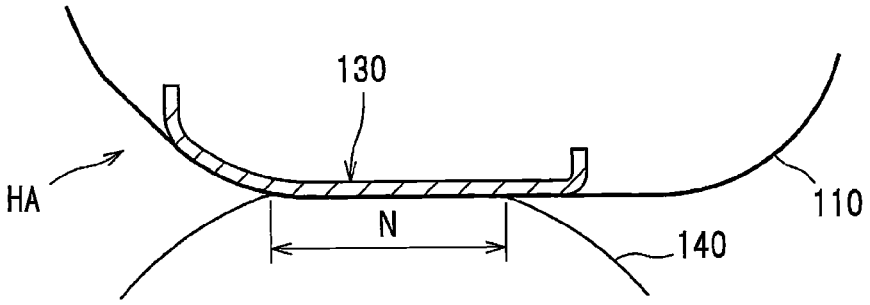
FIG.8B
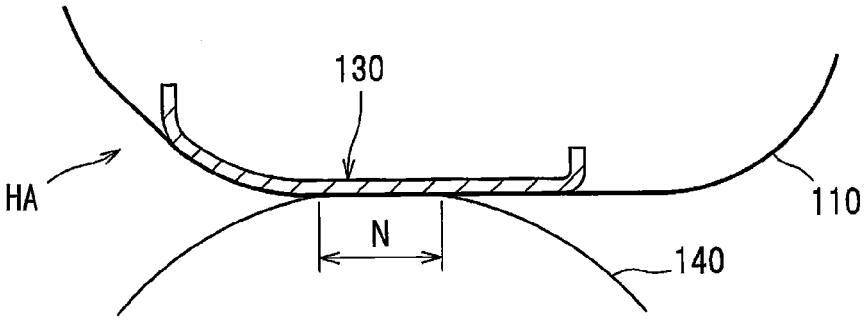
FIG.8C
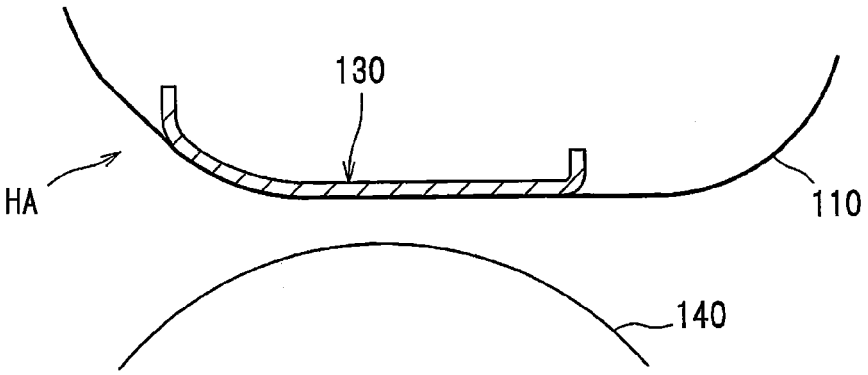

FIXING DEVICE PROVIDED WITH FRAME MOVABLY SUPPORTING HEATING ASSEMBLY

CROSS REFERENCE TO RELATED APPLICATION

This application claims priority from Japanese Patent Application No. 2012-288266 filed Dec. 28, 2012. The entire content of the priority application is incorporated herein by reference.

TECHNICAL FIELD

The present invention relates to a fixing device having a frame for supporting both a roller and a heating assembly that can be moved relative to the roller.

BACKGROUND

There is conventionally known a fixing device, provided in an electrophotographic image-forming device, including a heating assembly for heating recording sheets, a roller facing the heating assembly to nip recording sheets with the roller, and a frame for supporting both the heating assembly and the roller. The frame in this fixing device has a pair of guides for holding the heating assembly in position, with a guided portion of each guide provided on each side of the heating assembly relative to a conveying direction of the recording sheets. The pair of guides serves to fix the position of the heating assembly in the conveying direction and also serves to guide movement of the heating assembly when the heating assembly is moved toward and away from the roller.

SUMMARY

However, the guides in the conventional fixing device described above protrude beyond the heating assembly in a direction away from the roller. Consequently, if the frame buckles under the weight of the roller, causing the guides to lean toward the heating assembly, the portions of the guides protruding above the heating assembly may tilt against the top of the heating assembly, making it impossible to move the heating assembly relative to the roller.

In view of the foregoing, it is an object of the present invention to provide a fixing device that better ensures the movability of a heating assembly even if a frame supporting the heating assembly and the roller deforms.

In order to attain the above and other objects, the present invention may provide a fixing device including: a roller; a heating assembly; a pressing assembly; and a frame. The roller may have an axis extending in a first direction and be configured to rotate about the axis. The roller may have end portions in the first direction. The heating assembly may face the roller in a second direction perpendicular to the first direction. The heating assembly may be configured to provide a nip region in cooperation with the roller. The heating assembly may include a guided portion having a first surface and a second surface positioned opposite to the first surface in a third direction perpendicular to the first direction and the second direction. The pressing assembly may be configured to urge the heating assembly toward the roller. The frame may be configured to support the end portions of the roller and be configured to movably support the heating assembly in the second direction. The frame may have a first wall and a second wall facing the first wall in the third direction. The frame may include: a recessed portion; a first guide portion; and a second guide portion. The recessed portion may be defined by the first wall and the second wall, and may have an opening facing the heating assembly. The recessed portion may be configured to support the end portions of the roller. The first guide portion may be configured to guide movement of the heating assembly and be connected to the first wall. The first guide portion may have a first restriction surface that is configured to face the first surface in the third direction to restrict the guided portion from moving in the third direction. The first restriction surface may have a farthest end portion positioned farthest from the roller in the second direction. The farthest end portion of the first restriction surface may face the first surface in the third direction when the heating assembly is in its closest position to the roller. The second guide portion may be configured to guide movement of the heating assembly and be connected to the second wall. The guided portion may be configured to be interposed between the first guide portion and the second guide portion in the third direction. The second guide portion may be positioned opposite to the first guide portion in the third direction. The second guide portion may have a second restriction surface that is configured to face the second surface in the third direction to restrict the guided portion from moving in the third direction. The second restriction surface may have a farthest end portion positioned farthest from the roller in the second direction. The farthest end portion of the second restriction surface may face the second surface in the third direction when the heating assembly is in its closest position to the roller.

According to another aspect, the present invention may provide a fixing device including: a roller; a heating assembly; a pressing assembly; and a frame. The roller may have an axis extending in a first direction and be configured to rotate about the axis. The roller may have end portions in the first direction. The heating assembly may face the roller in a second direction perpendicular to the first direction. The heating assembly may be configured to provide a nip region in cooperation with the roller. The heating assembly may include a guided portion having a third surface and a fourth surface positioned opposite to the third surface in a third direction perpendicular to the first direction and the second direction. The third surface may be formed with a first groove recessed toward the fourth surface in the third direction. The fourth surface may be formed with a second groove recessed toward the third surface in the third direction. The pressing assembly may be configured to urge the heating assembly toward the roller. The frame may be configured to support the end portions of the roller and be configured to movably support the heating assembly in the second direction. The frame may have a first wall and a second wall facing the first wall in the third direction. The frame may include: a recessed portion; a first guide portion; and a second guide portion. The recessed portion may be defined by the first wall and the second wall, and may have an opening facing the heating assembly. The recessed portion may be configured to support the end portions of the roller. The first guide portion may be configured to guide movement of the heating assembly and be connected to the first wall. The first guide portion may have a first protrusion protruding toward the first groove. The first protrusion may be configured to be fitted into the first groove. The first protrusion may have a first endface, and the first endface may have a farthest end portion positioned farthest from the roller in the second direction. The farthest end portion of the first endface may face the first groove in the third direction when the heating assembly is in its closest position to the roller. The second guide portion may be configured to guide movement of the heating assembly and be connected to the second wall. The guided portion may be configured to be interposed between the first guide portion and the second guide portion in the third direction. The second guide portion may be positioned opposite to the first guide portion in the third direction. The second guide portion may have a second protrusion protruding toward the second groove. The second protrusion may be configured to be fitted into the second groove. The second protrusion may have a second endface, and the second endface may have a farthest end portion positioned farthest from the roller in the second direction. The farthest end portion of the second endface may face the second groove in the third direction when the heating assembly is in its closest position to the roller.

According to still another aspect, the present invention may provide a fixing device including: a roller; a heating assembly; a pressing assembly; and a frame. The roller may have an axis extending in a first direction and be configured to rotate about the axis. The roller may have end portions in the first direction. The heating assembly may face the roller in a second direction perpendicular to the first direction. The heating assembly may be configured to provide a nip region in cooperation with the roller. The heating assembly may include a guided portion having a first surface and a second surface positioned opposite to the first surface in a third direction perpendicular to the first direction and the second direction. The pressing assembly may be configured to urge the heating assembly toward the roller. The frame may be configured to support the end portions of the roller and be configured to movably support the heating assembly in the second direction. The frame may have a first wall and a second wall facing the first wall in the third direction. The frame may include: a recessed portion; a first guide portion; and a second guide portion. The recessed portion may be defined by the first wall and the second wall, and has an opening facing the heating assembly. The recessed portion may be configured to support the end portions of the roller. The first guide portion may be configured to guide movement of the heating assembly and be connected to the first wall. The first guide portion may have a fifth surface facing the first surface in the third direction. The fifth surface may have a farthest end portion positioned farthest from the roller in the second direction. The farthest end portion of the fifth surface may face the first surface in the third direction when the heating assembly is in its closest position to the roller. The second guide portion may be configured to guide movement of the heating assembly and be connected to the second wall. The guided portion may be configured to be interposed between the first guide portion and the second guide portion in the third direction. The second guide portion may be positioned opposite to the first guide portion in the third direction. The second guide portion may have a sixth surface facing the second surface in the third direction. The sixth surface may have a farthest end portion positioned farthest from the roller in the second direction. The farthest end portion of the sixth surface may face the second surface in the third direction when the heating assembly is in its closest position to the roller.

BRIEF DESCRIPTION OF THE DRAWINGS

In the drawings;

FIG. 8A is a view showing a position of a nip plate and the pressure roller when the pressing assembly is in the first state;

FIG. 8B is a view showing a position of the nip plate and the pressure roller when the pressing assembly is in the second state; and FIG. 8C is a view showing a position of the nip plate and the pressure roller when the pressing assembly is in the fourth state.

DETAILED DESCRIPTION

Next, a general structure of a laser printer 1 provided with a fixing device 100 according to one embodiment of the present invention will be described with reference to FIG. 1. A detailed structure of the fixing device 100 will be described later while referring to FIGS. 2 to 8C.

Throughout the specification, the terms "upward", "downward", "upper", "lower", "above", "below", "beneath", "right", "left", "front", "rear" and the like will be used assuming that the laser printer 1 is disposed in an orientation in which it is intended to be used. More specifically, in FIG. 1, a left side and a right side are a front side and a rear side, respectively. Further, in FIG. 1, a far side and a near side are a left side and a right side, respectively. Further, in FIG. 1, a top side and a bottom side are a top side and a bottom side, respectively.

<General Structure of Laser Printer>

Figure 1:
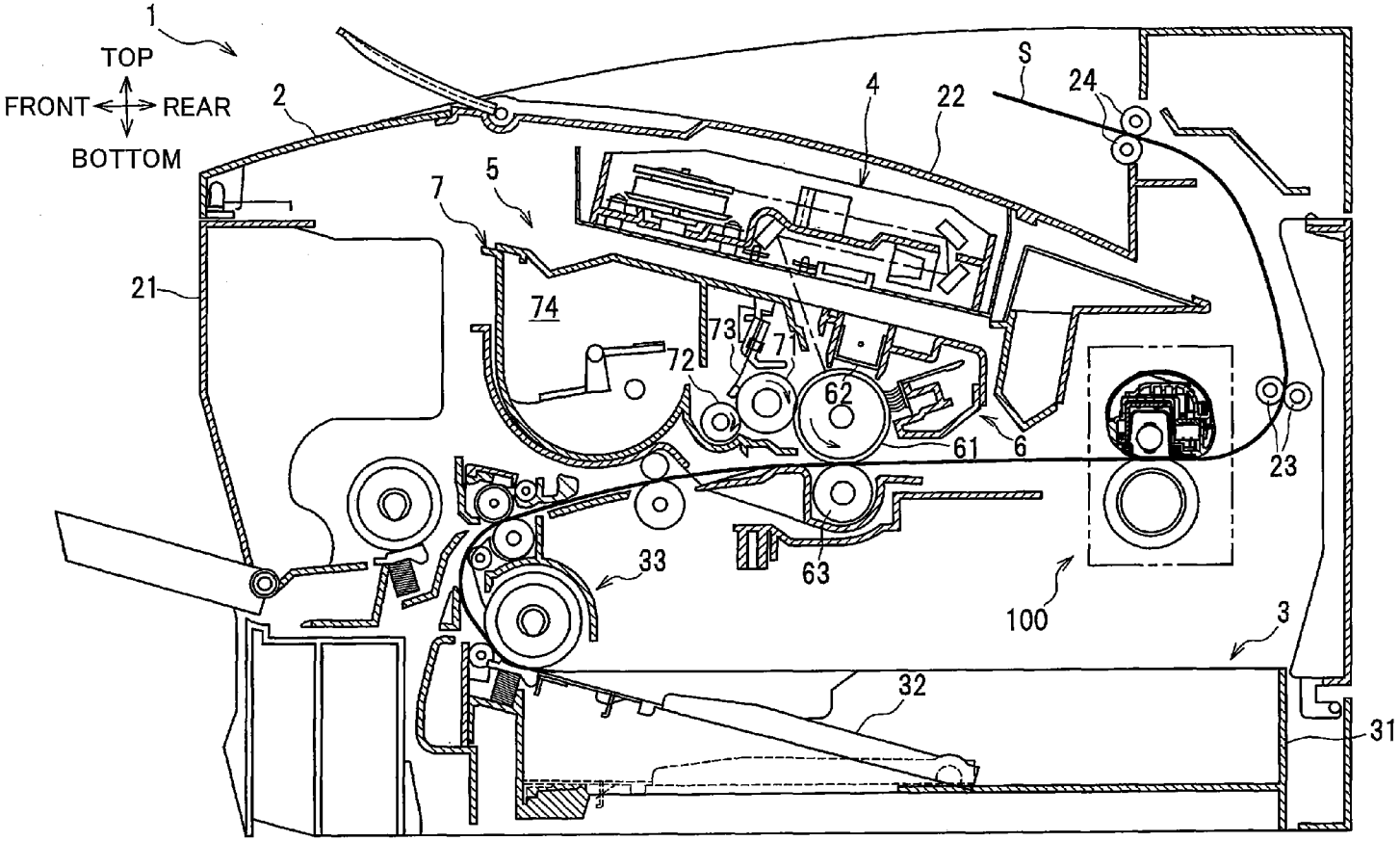
FIG. 1 is a schematic cross-sectional view showing a structure of a laser printer having a fixing device according to one embodiment of the present invention.

As shown in FIG. 1, the laser printer 1 includes a main frame 2 with a movable front cover 21. Within the main frame 2, a sheet supply unit 3 for supplying a sheet S, an exposure unit 4, a process cartridge 5 for transferring a toner image on the sheet S, and the fixing device 100 for thermally fixing the toner image onto the sheet S are provided.

The sheet supply unit 3 is disposed at a lower portion of the main frame 2. The sheet supply unit 3 includes a sheet supply tray 31, a lifter plate 32, and a sheet supply mechanism 33. Each sheet S accommodated in the sheet supply tray 31 is directed upward by the lifter plate 32 to be supplied toward the process cartridge 5 (i.e. a position between a photosensitive drum 61 and a transfer roller 63) by the sheet supply mechanism 33.

The exposure unit 4 is disposed at an upper portion of the main frame 2. The exposure unit 4 includes a laser emission unit (not shown), a polygon mirror (shown in FIG. 1 without a reference numeral), lenses (shown in FIG. 1 without a reference numeral), and reflection mirrors (shown in FIG. 1 without a reference numeral). In the exposure unit 4, the laser emission unit projects a laser beam (indicated by a chain line in FIG. 1) based on image data, so that a surface of the photosensitive drum 61 is subjected to high speed scan of the laser beam. Hence, the surface of the photosensitive drum 61 is exposed to the laser beam.

The process cartridge 5 is disposed below the exposure unit 4. The process cartridge 5 is detachable and attachable relative to the main frame 2 through a front opening defined by the front cover 21 at an open position. The process cartridge 5 includes a drum unit 6 and a developing unit 7.

The drum unit 6 includes the photosensitive drum 61, a charger 62, and the transfer roller 63. The developing unit 7 is detachably mountable in the drum unit 6. The developing unit 7 includes a developing roller 71, a toner supply roller 72, a layer thickness regulation blade 73, and a toner accommodating portion 74 in which toner (developer) is accommodated.

In the process cartridge 5, after the surface of the photosensitive drum 61 has been uniformly charged by the charger 62, the surface is subjected to high speed scan of the laser beam from the exposure unit 4. An electrostatic latent image based on the image data is thereby formed on the surface of the photosensitive drum 61. The toner accommodated in the toner accommodating portion 74 is supplied to the developing roller 71 via the toner supply roller 72. The toner is conveyed between the developing roller 71 and the layer thickness regulation blade 73 so as to be deposited on the developing roller 71 as a thin layer having a uniform thickness.

The toner deposited on the developing roller 71 is supplied to the electrostatic latent image formed on the photosensitive drum 61. Hence, a visible toner image corresponding to the electrostatic latent image is formed on the photosensitive drum 61. Then, the sheet S is conveyed between the photosensitive drum 61 and the transfer roller 63, so that the toner image formed on the photosensitive drum 61 is transferred onto the sheet S.

The fixing device 100 is disposed rearward of the process cartridge 5. The toner image transferred onto the sheet S is thermally fixed on the sheet S while the sheet S passes through the fixing device 100. The sheet S on which the toner image is thermally fixed is conveyed by conveying rollers 23 and 24 to be discharged on a discharge tray 22.

<Detailed Structure of Fixing Device>

Figure 2:
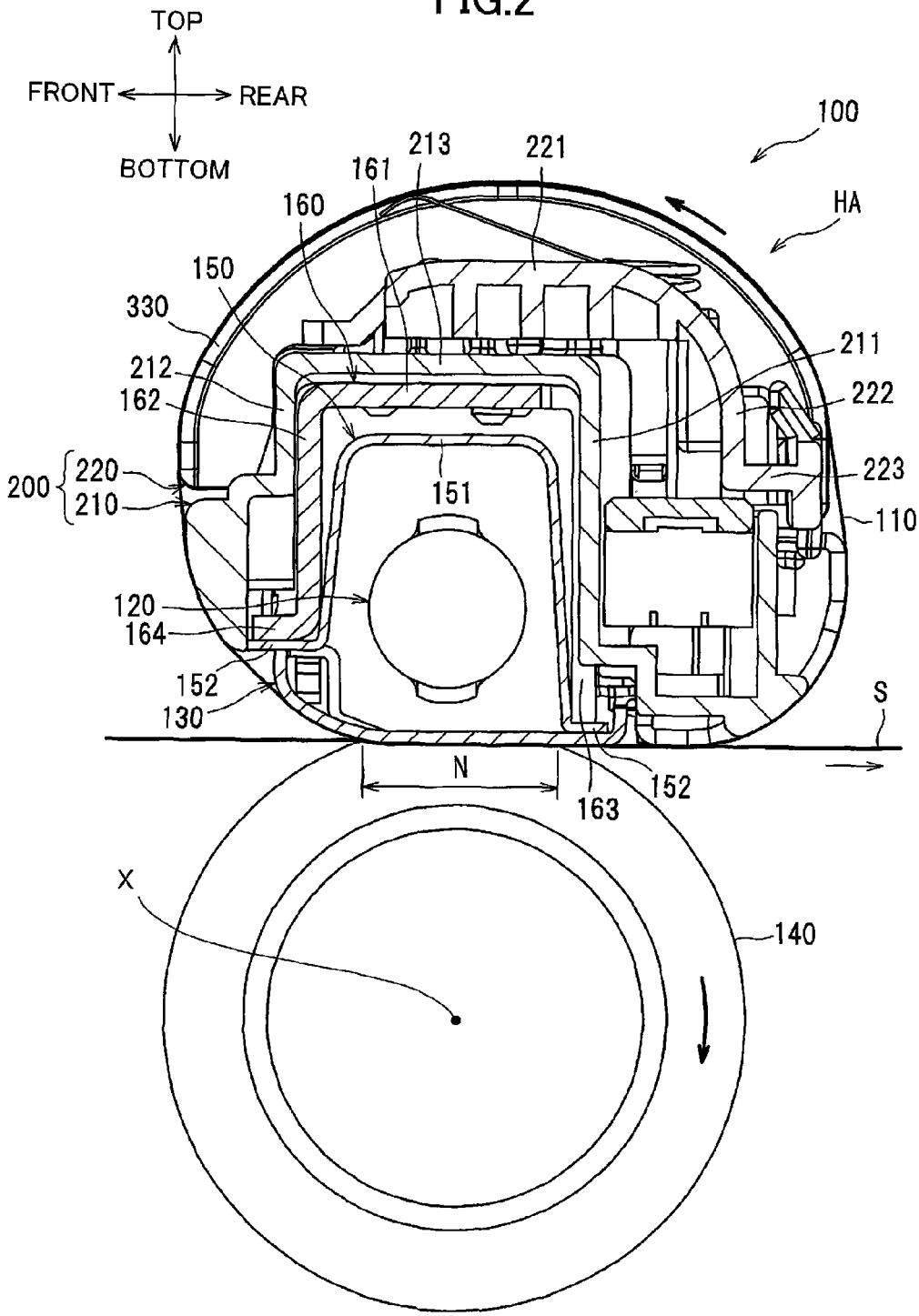
FIG. 2 is a schematic cross-sectional view showing a heating assembly and a pressure roller of the fixing device.

As shown in FIG. 2, the fixing device 100 includes a fusing belt 110, a halogen lamp 120, a nip plate (nip member) 130, a pressure roller (roller) 140, a reflection plate 150, a stay 160, and a cover unit 200.

The fusing belt 110, the halogen lamp 120, the nip plate 130, the reflection plate 150, the stay 160, and the cover unit 200 constitute a heating assembly HA for heating the sheet S. The heating assembly HA faces the pressure roller 140 in a vertical direction (second direction).

The fusing belt 110 is an endless belt having heat resistivity and flexibility. Each widthwise end portion of the fusing belt 110 is guided by a left and right pair of end guide portions 330 provided at the cover unit 200, so that the fusing belt 110 is circularly movable.

The halogen lamp 120 is a heater for heating toner on the sheet S, by generating radiant heat to heat the nip plate 130 and the fusing belt 110 (i.e. a nip region N). The halogen lamp 120 is positioned at an internal space of the fusing belt 110, and is spaced away from an inner surface of the nip plate 130 and from an inner peripheral surface of the fusing belt 110 by a predetermined distance.

The nip plate 130 is formed in a plate shape and adapted to receive the radiant heat from the halogen lamp 120. The nip plate 130 is positioned atm the internal space of the fusing belt 110 so that the inner peripheral surface of the fusing belt 110 is in sliding contact with a lower surface of the nip plate 130. In the present embodiment, the nip plate 130 is made from a metallic material such as aluminum having a thermal conductivity higher than that of the stay 160 (described later) made from steel. For fabricating the nip plate 130, an aluminum plate is bent. In a case where the nip plate 130 is made from aluminum, a heat conductivity of the nip plate 130 can be enhanced.

The pressure roller 140 is a roller configured to rotate about an axis X extending in a left-right direction (first direction). The pressure roller 140 is positioned below the nip plate 130 and nips the fusing belt 110 in cooperation with the nip plate 130 to provide the nip region N for nipping the sheet S between the pressure roller 140 and the fusing belt 110. In the present embodiment, to provide the nip region N, the nip plate 130 is pressed toward the pressure roller 140. The pressure roller 140 is rotated to circularly move the fusing belt 110 while nipping the fusing belt 110 in cooperation with the nip plate 130, thereby conveying the sheet S rearward in cooperation with the fusing belt 110.

The pressure roller 140 is rotationally driven upon transmission of a drive force from a drive motor (not shown) disposed in the main frame 2. By the rotation of the pressure roller 140, the fusing belt 110 is circularly moved because of a friction force generated therebetween or between the sheet S and the fusing belt 110. A toner image (toner) transferred onto the sheet S can be thermally fixed thereto by heat and pressure during passage of the sheet S at the nip region N between the pressure roller 140 and the heated fusing belt 110.

The reflection plate 150 is adapted to reflect the radiant heat from the halogen lamp 120 toward the nip plate 130. The reflection plate 150 is positioned in the internal space of the fusing belt 110 and surrounds the halogen lamp 120, with a predetermined distance therefrom.

The reflection plate 150 is configured into U-shape in cross-section and is made from a material such as aluminum having high reflection ratio regarding infrared ray and far infrared ray. More specifically, the reflection plate 150 has a U-shaped reflection portion 151, and front and rear flange portions 152 respectively extending in the front-rear direction outward from front and rear end portions of the reflection portion 151. In other words, each flange portion 152 extends outward in the front-rear direction from each end portion of the reflection portion 151 positioned on the nip plate 130 side.

Each flange portion 152 is interposed between the stay 160 and the nip plate 130.

The stay 160 is adapted to support the nip plate 130 through the reflection plate 150 to receive a load from the pressure roller 140. The stay 160 is positioned in the internal space of the fusing belt 110 and surrounds the halogen lamp 120 and the reflection plate 150. Incidentally, the load referred to herein implies a reaction force of a force that the nip plate 130 presses the pressure roller 140.

The stay 160 has a U-shaped cross-section to have a top wall 161, a front wall 162 extending downward from a front end portion of the top wall 161, and a rear wall 163 extending downward from a rear end portion of the top wall 161. The front wall 162 has a bottom end portion at which a flange portion 164 is formed. The flange portion 164 extends frontward from the front wall 162. Further, the stay 160 has pressed portions 165 each provided at each left-right end portion of the top wall 161. The stay 160 is made from a material such as steel having high rigidity and fabricated by folding a steel plate.

Figure 3:
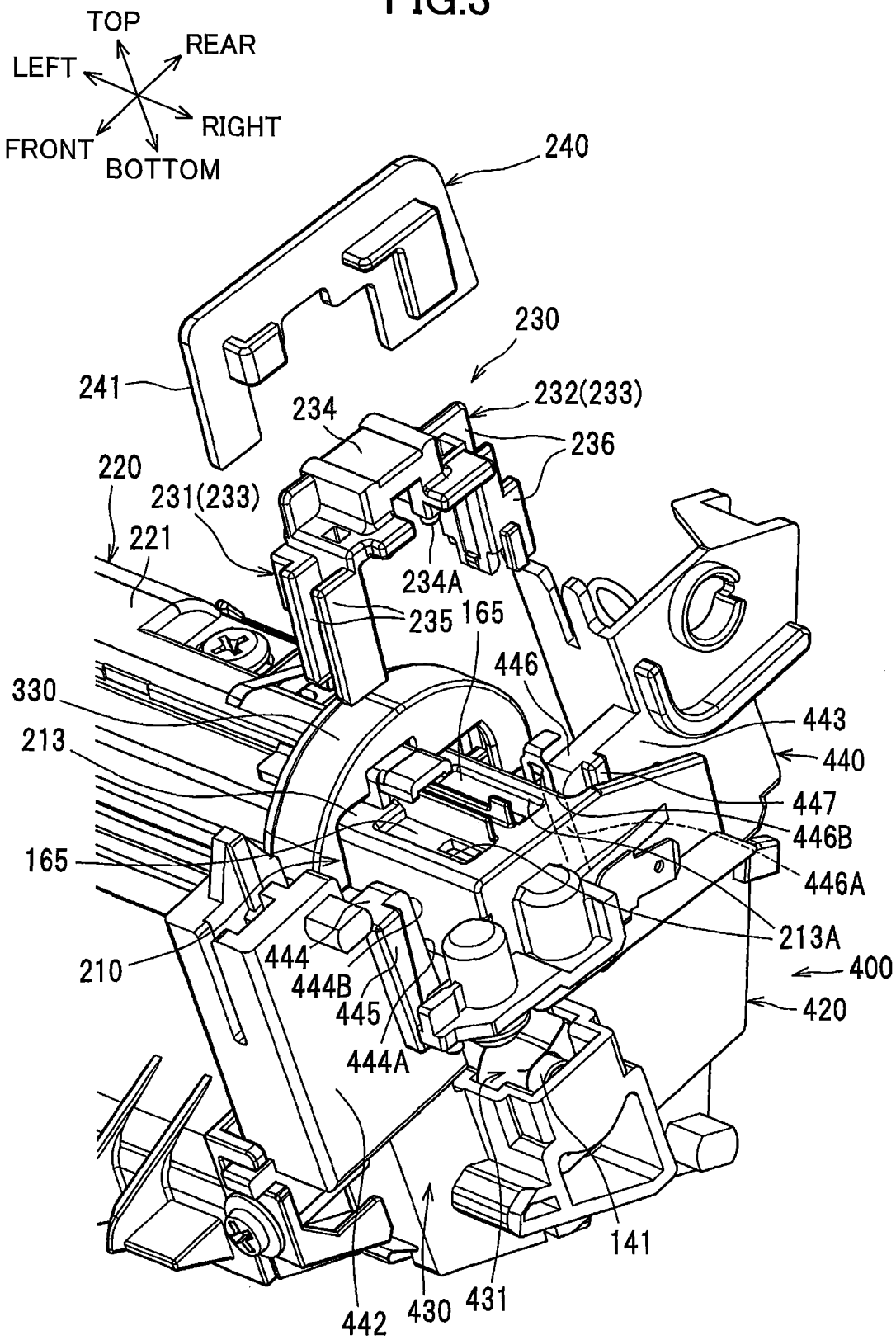
FIG. 3 is an exploded perspective view showing a right end portion of the fixing device from which a pressing assembly and a second frame is omitted.

The cover unit 200 includes a first cover member 210 (see FIGS. 2 and 3), a second cover member 220 (see FIGS. 2 and 3), a left and right pair of third cover members 230 (see FIG. 3), and a left and right pair of endface guide members 240 (see FIG. 3). The parts constituting the cover unit 200 are formed of resin. Note that both left and right end portions of the cover unit 200 have substantially the same structure. Therefore, only the right end portion of the cover unit 200 is shown in FIG. 3.

As shown in FIGS. 2 and 3, the first cover member 210 has a U-shaped cross-section and is elongated in the left-right direction. The first cover member 210 covers the stay 160 and is disposed opposite to the halogen lamp 120 with respect to the stay 160.

As shown in FIG. 2, the first cover member 210 is primarily configured of a rear wall 211, a front wall 212, and a top wall 213 that extends between and connects to the top edges of the rear wall 211 and the front wall 212. As shown in FIG. 3, the top wall 213 of the first cover member 210 extends farther outward in the left-right direction than the second cover member 220. Two openings 213A are formed in the portion of the top wall 213 extending from the outer side of the second cover member 220 for exposing the pressed portion 165 on the respective left-right end portion of the stay 160. The two openings 213A are provided on each of the left and right end portions of the first cover member 210 and are spaced apart from each other in the front-rear direction.

As shown in FIG. 3, the second cover member 220 is elongated in the left-right direction and is disposed above the first cover member 210 so as to cover a part of the first cover member 210. As shown in FIG. 2, the second cover member 220 primarily includes a top wall 221, a rear wall 222 that extends downward from a rear edge of the top wall 221, and an extension wall 223 that extends rearward from a bottom edge of the rear wall 222. As shown in FIG. 3, the pair of end guide portions 330 mentioned above is integrally formed on the left and right end portions of the top wall 221, with one on each end portion, for guiding the upper portion of the fusing belt 110.

As shown in FIG. 3, the pair of endface guide members 240 are provided one each on the outer left and right sides of the second cover member 220 and are disposed adjacent to the corresponding end guide portions 330 of the second cover member 220. Each of the pair of endface guide members 240 has a restriction surface 241 that regulates the position of the fusing belt 110 by abutting the corresponding edge of the fusing belt 110.

The left and right third cover members 230 serve to cover the respective left and right end portions of the first cover member 210 and are provided separately from the left and right endface guide members 240 and the left and right end guide portions 330. Each third cover member 230 is supported by a first frame 400 (described later) so as to be capable of moving vertically (i.e., in the direction that the heating assembly HA opposes the pressure roller 140), while movement in the front-rear and left-right directions is restricted (see also FIG. 5).

The pair of third cover members 230 has a generally U-shaped cross-section that opens downward. Each of the pair of third cover members 230 includes a guided portion 233 and a top wall 234. The guided portion 233 is configured of a first wall 231, and a second wall 232 that is spaced apart from the first wall 231 in the front rear direction. The top wall 234 bridges top edges of the first wall 231 and the second wall 232.

The guided portion 233 is positioned such that the first wall 231 is on the front side of the first cover member 210 while the second wall 232 is on the rear side of the first cover member 210, so that the first cover member 210 is interposed between the first wall 231 and the second wall 232 in the front-rear direction.

Figure 4:
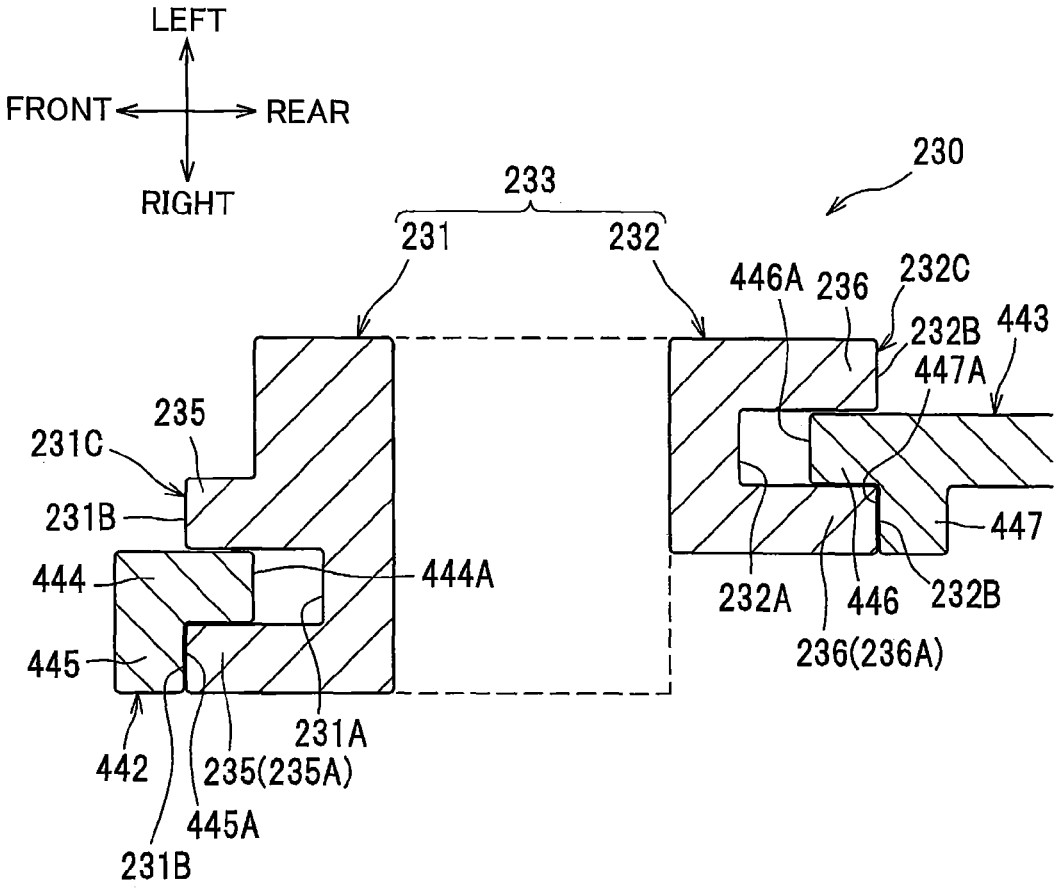
FIG. 4 is a schematic cross-sectional view of a third cover member and first and second guide parts of a first frame of the fixing device along a horizontal plane.

As shown in FIGS. 3 and 4, the first wall 231 is provided with a pair of first ribs 235 that protrudes forward from a wall surface of the first wall 231 facing forward (the surface facing outward with respect to the front-rear direction). The pair of first ribs 235 is spaced apart from each other in the left-right direction and is elongated vertically. The pair of first ribs 235 includes an outer first rib 235A disposed outward of the other first rib 235 with respect to the left-right direction. Providing the pair of first ribs 235 on the first wall 231 forms a first groove 231A. The first groove 231A is recessed rearward into the first wall 231, more specifically, into a front surface 231C (third surface) of the first wall 231 which is configured of endfaces 231B on the first ribs 235. The first groove 231A is elongated vertically.

As shown in FIGS. 3 and 4, the second wall 232 is provided with a pair of second ribs 236 that protrudes rearward from a wall surface of the second wall 232 facing rearward (the surface facing outward with respect to the front-rear direction). The pair of second ribs 236 is spaced apart from each other in the left-right direction and is elongated vertically. The pair of second ribs 236 includes an outer second rib 236A disposed outward of the other second rib 236 with respect to the left-right direction. Providing the pair of second ribs 236 on the second wall 232 forms a second groove 232A. The second groove 232A is recessed forward into the second wall 232, more specifically, into a rear surface 232C (fourth surface) of the second wall 232 which is configured of endfaces 232B on the second ribs 236. The second groove 232A is elongated vertically.

As shown in FIG. 3, the top wall 234 has two pressing protrusions 234A (only one is shown in FIG. 3). The two pressing protrusions 234A are spaced apart from each other in the front-rear direction and protrude downward from a bottom surface of the top wall 234 (the surface facing the stay 160). The two pressing protrusions 234A are provided at positions corresponding to the two openings 213A formed in the first cover member 210. Consequently, when pressure is applied to the third cover member 230 by an arm member 510 (FIG. 5, described later), the third cover member 230 directly applies pressure to the corresponding pressed portion 165 of the stay 160 through the two openings 213A.

Figure 5:
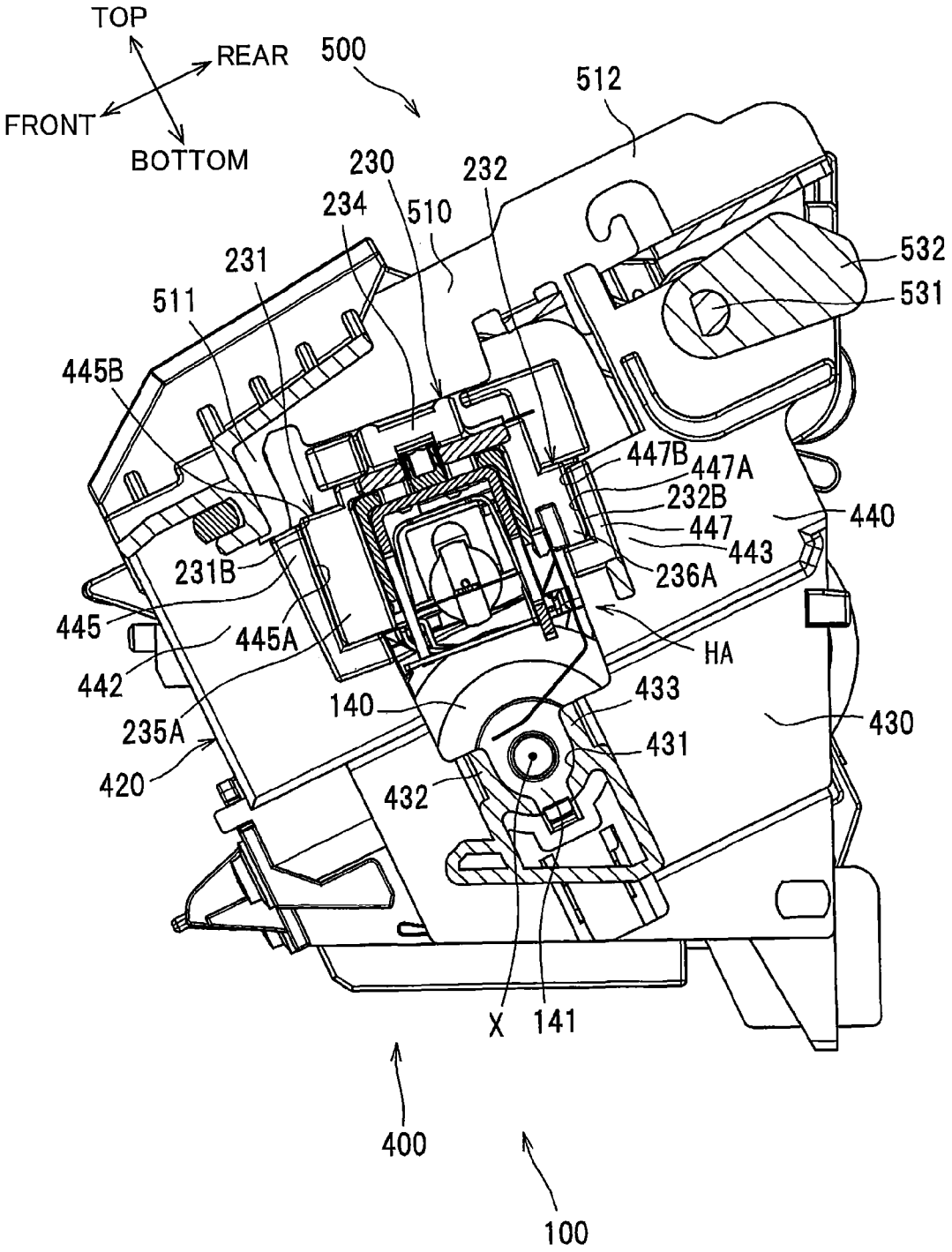
FIG. 5 is a schematic cross-sectional view showing the right end portion of the fixing device.
Figure 6:
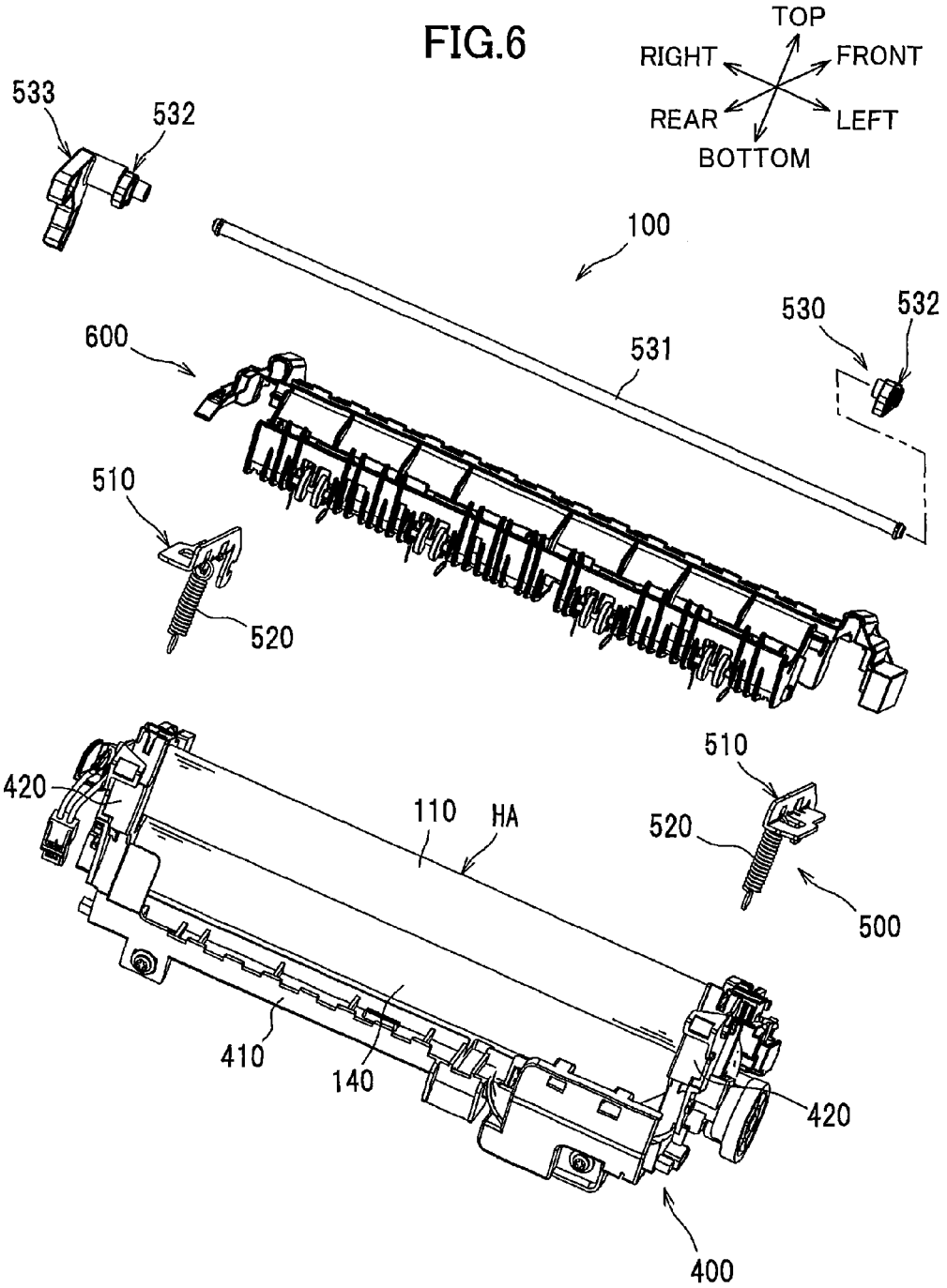
FIG. 6 is an exploded perspective view of the heating assembly.

In addition to the components of the fixing device 100 described above, the fixing device 100 includes the first frame 400 (frame), a pressing assembly 500 provided at the first frame 400, and a second frame 600 covering the top of the first frame 400, as shown in FIGS. 5 and 6.

The first frame 400 is formed of resin. The first frame 400 is primarily configured of a bottom wall 410 (FIG. 6), and a left and right pair of side walls 420 (FIGS. 5 and 6) protruding upward from the corresponding left and right edges of the bottom wall 410. Since both left and right side walls 420 have substantially the same structure, only the right side wall 420 will be described in detail below.

As shown in FIG. 5, each of the pair of side walls 420 includes a roller support portion 430 and a heating-assembly support portion 440. The roller support portion 430 is adapted to support the corresponding left-right end of the pressure roller 140 through a bearing portion 141 (see also FIG. 3). The heating-assembly support portion 440 is provided above the roller support portion 430 and adapted to support the heating assembly HA so that the heating assembly HA can move vertically. The roller support portion 430 and the heating-assembly support portion 440 are integrally molded to constitute the side wall 420. The pressing assembly 500 is provided at the pair of side walls 420 of the first frame 400. The pressing assembly 500 is adapted to press the heating assembly HA toward the pressure roller 140.

The roller support portion 430 has a recessed part 431 formed in the top edge thereof. The recessed part 431 has a generally U-shaped cross-section that opens upward, with the opening opposing the heating assembly HA vertically. More specifically, a front edge of the recessed part 431 is defined by a front wall 432 of the roller support portion 430, while a rear edge of the recessed part 431 is defined by a rear wall 433 of the roller support portion 430. The bearing portion 141 provided at the left right end of the pressure roller 140 is fitted into the corresponding recessed part 431. Hence, the left and right recessed parts 431 support the left and right ends of the pressure roller 140, respectively.

The heating-assembly support portion 440 has a first guide part 442 and a second guide part 443. The first guide part 442 is provided on the front side of the third cover member 230. The second guide part 443 is provided on the rear side of the third cover member 230. Hence, the third cover member 230 of the heating assembly HA is interposed between the first guide part 442 and the second guide part 443 in the front-rear direction (third direction).

The first guide part 442 is connected to the front wall 432, while the second guide part 443 is connected to the rear wall 433.

As shown in FIGS. 3 and 4, the first guide part 442 has a first protrusion 444 and a first restriction wall 445. The first protrusion 444 is provided at a rear portion of the first guide part 442 (i.e. a portion of the first guide part 442 facing the third cover member 230) and protrudes toward the first groove 231A of the third cover member 230. The first restriction wall 445 protrudes outward in the left-right direction from an outer left-right surface of the first protrusion 444.

The first protrusion 444 is formed with a thickness in the left-right direction substantially the same as the gap between the pair of first ribs 235. More specifically, the first protrusion 444 has an endface 444A that has a left-right length substantially the same as the gap between the first ribs 235. The endface 444A is elongated vertically. The first protrusion 444 is interposed between the pair of first ribs 235. In other words, the first protrusion 444 is fitted into the first groove 231A. In this way, the first protrusion 444 restricts a front portion of the third cover member 230 (the heating assembly HA) from moving in the left-right direction.

The endface 444A of the first protrusion 444 has an upper end 444B (i.e. the end farthest from the pressure roller 140 in the vertical direction). The upper end 444B is positioned at a height such that the upper end 444B faces the first groove 231A when the heating assembly HA is in its closest position to the pressure roller 140 (the position shown in FIG. 8A). In other words, the upper end 444B on the endface 444A of the first protrusion 444 is aligned with the first groove 231A in the front-rear direction when the heating assembly HA is in this position. That is, the upper end 444B overlaps with the first groove 231A as viewed in the front-rear direction.

The first restriction wall 445 has a first restriction surface 445A (fifth surface) facing rearward. The first restriction surface 445A opposes the endface 231B on the outer first rib 235A.

The first restriction surface 445A is the surface of the first guide part 442 that is nearest the first wall 231 with respect to the front-rear direction. The first restriction surface 445A restricts the third cover member 230 (the heating assembly HA) from moving forward when abutting the endface 231B on the outer first rib 235A (first surface). As shown in FIG. 5, the first restriction surface 445A extends vertically along the endface 231B on the outer first rib 235A and serves to guide the vertical movement of the first wall 231.

As shown in FIG. 5, the first restriction surface 445A has an upper end 445B (i.e., the end farthest from the pressure roller 140 in the vertical direction). The upper end 445B is positioned at a height such that the upper end 445B faces the endface 231B of the outer first rib 235A when the heating assembly HA is in its closest position to the pressure roller 140 (the position shown in FIG. 8A). Hence, the upper end 445B on the first restriction surface 445A is positioned lower than the top edge of the endface 231B on the outer first rib 235A. In other words, when the heating assembly HA is in this position, the upper end 445B on the first restriction surface 445A is aligned with the endface 231B on the outer first rib 235A in the front-rear direction. That is, the upper end 445B overlaps with the endface 231B on the outer first rib 235A as viewed in the front-rear direction.

As shown in FIGS. 3 and 4, the second guide part 443 has a second protrusion 446 and a second restriction wall 447. The second protrusion 446 is provided at a front portion of the second guide part 443 (i.e., a portion of the second guide part 443 facing the third cover member 230) and protrudes toward the second groove 232A of the third cover member 230. The second restriction wall 447 protrudes outward in the left right direction from an outer left-right surface of the second protrusion 446.

The second protrusion 446 is formed with a thickness in the left-right direction substantially the same as the gap between the pair of second ribs 236. More specifically, the second protrusion 446 has an endface 446A that has a left-right length substantially the same as the gap between the second ribs 236. The endface 446A is elongated vertically. The second protrusion 446 is interposed between the pair of second ribs 236. In other words, the second protrusion 446 is fitted into the second groove 232A. In this way, the second protrusion 446 restricts a rear portion of the third cover member 230 (the heating assembly HA) from moving in the left-right direction.

The endface 446A of the second protrusion 446 has an upper end 446B (i.e. the end farthest from the pressure roller 140 in the vertical direction). The upper end 446B is positioned at a height such that the upper end 446B faces the second groove 232A when the heating assembly HA is in its closest position to the pressure roller 140 (the position shown in FIG. 8A). In other words, the upper end 446B on the endface 446A of the second protrusion 446 is aligned with the second groove 232A in the front-rear direction when the heating assembly HA is in this position. That is, the upper end 446B overlaps with the second groove 232A as viewed in the front-rear direction.

The second restriction wall 447 has a second restriction surface 447A (sixth surface) facing forward. The second restriction surface 447A opposes the endface 232B on the outer second rib 236A.

The second restriction surface 447A is the surface of the second guide part 443 that is nearest the second wall 232 with respect to the front-rear direction. The second restriction surface 447A restricts the third cover member 230 (the heating assembly HA) from moving rearward when abutting the endface 232B of the outer second rib 236A. As shown in FIG. 5, the second restriction surface 447A extends vertically along the endface 232B on the outer second rib 236A and serves to guide the vertical movement of the second wall 232.

As shown in FIG. 5, the second restriction surface 447A has an upper end 447B (i.e., the end farthest from the pressure roller 140 in the vertical direction). The upper end 447B is positioned at a height such that the upper end 447B faces the endface 232B of the outer second rib 236A when the heating assembly HA is in its closest position to the pressure roller 140 (the position shown in FIG. 8A). Hence, the upper end 447B on the second restriction surface 447A is positioned lower than the top edge of the endface 232B on the outer second rib 236A. In other words, when the heating assembly HA is in this position, the upper end 447B on the second restriction surface 447A is aligned with the endface 232B on the outer second rib 236A in the front rear direction. That is, the upper end 447B overlaps with the endface 232B on the outer second rib 236A as viewed in the front-rear direction.

The pressing assembly 500 serves to urge the heating assembly HA (the nip plate 130) toward the pressure roller 140. As shown in FIG. 6, the pressing assembly 500 is primarily configured of a pair of arm members 510, a pair of helical extension springs 520, and a moving mechanism 530.

Figure 7A:
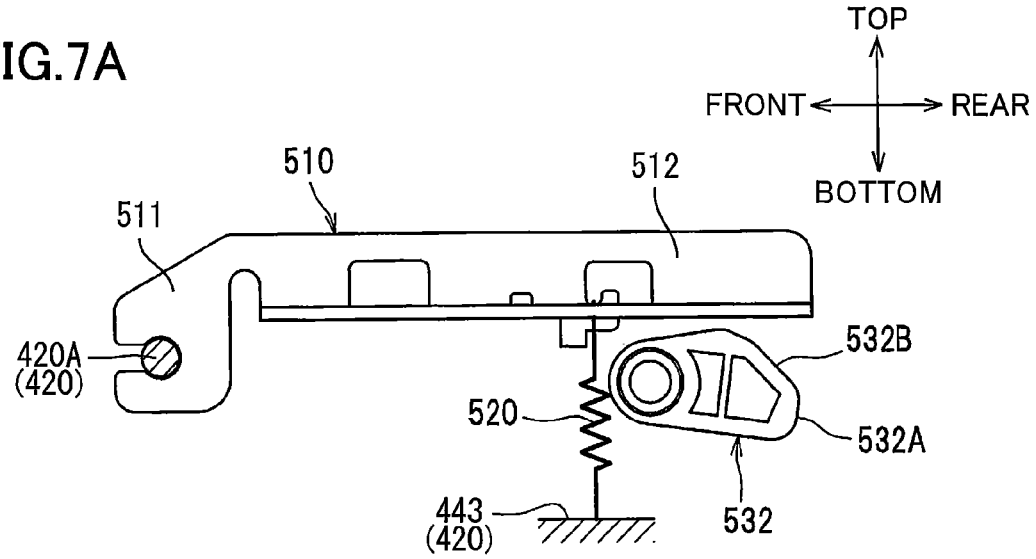
FIG. 7A is a view showing a first state of the pressing assembly.

One of the pair of arm members 510 is disposed above each of the left and right end portions of the heating assembly HA. More specifically, the left arm member 510 is disposed above the left third cover member 230, and the right arm member 510 is disposed above the right third cover member 230. The left arm member 510 and the right arm member 510 have left-right symmetry, that is, are of a left-right symmetric configuration. As shown in FIGS. 5 and 6, each of the pair of arm members 510 is pivotally movably supported at the side wall 420 of the first frame 400 (see also FIGS. 7A through 7C). More specifically, each of the pair of arm members 510 has a front end 511 that is positioned forward of the heating assembly HA, and each of the pair of side walls 420 has a shaft part 420A formed at a position forward of the recessed part 431. The front end 511 is pivotally movable about the shaft part 420A at a position above the corresponding first guide part 442. Each of the pair of arm members 510 also has a rear end 512 that is positioned rearward of the heating assembly HA. The rear end 512 is urged downward by the corresponding helical extension spring 520. More specifically, as shown in FIG. 7A, each of the pair of helical extension springs 520 has a top end that is anchored to the rear end 512 of the corresponding arm member 510, and a bottom end that is anchored to the corresponding side wall 420 of the first frame 400. More specifically, the bottom end of each helical extension spring 520 is anchored to a top portion of the corresponding second guide part 443, that is, to a portion disposed rearward of the recessed part 431. Each helical extension spring 520 is adapted to pull the corresponding arm member 510 toward the first frame 400.

As shown in FIG. 5, each of the pair of arm members 510 having the above structure contacts a top surface of the corresponding third cover member 230 with its center region, thereby urging the heating assembly HA toward the pressure roller 140.

The moving mechanism 530 actuates the pair of arm members 510 for moving the heating assembly HA vertically relative to the pressure roller 140. As shown in FIGS. 5 and 6, the moving mechanism 530 is configured of a shaft 531, left and right cams 532, and an operating lever 533.

The shaft 531 is a rod-shaped member that extends in the left-right direction. The shaft 531 is inserted through openings formed in the pair of side walls 420 of the first frame 400 and is rotatably supported at the first frame 400.

The left cam 532 is provided on a left end of the shaft 531, and the right cam 532 is provided on a right end of the shaft 531. Each of the left and right cams 532 is adapted to apply a force to the corresponding arm member 510.

More specifically, the left and right cams 532 are fixed to the corresponding left and right ends of the shaft 531. The left and right cams 532 are shaped to protrude radially outward from the shaft 531. Each of the left and right cams 532 has a circumferential surface including a complete release surface 532A and a release surface 532B. The release surface 532B is positioned closer to the shaft 531 than the complete release surface 532A to the shaft 531. Both of the left and right cams 532 are disposed beneath the rear ends 512 of the corresponding arm members 510.

The operating lever 533 is integrally provided at one of the left and right cams 532 for rotating the shaft 531. More specifically, in this embodiment, the operating lever 533 is integrally formed on the right cam 532. The operating lever 533 is rotated either by a user or through a mechanism well known in the art (such as a mechanism operating in conjunction with the opening and closing operations of the front cover 21).

The pressing assembly 500 having the structure described above can be switched between a first state in which the heating assembly HA contacts the pressure roller 140 with a first pressure force, and a second state in which the heating assembly HA contacts the pressure roller 140 with a second pressure force that is smaller than the first pressure force.

The pressing assembly 500 can also be switched between a third state, including the first and second states described above, in which the heating assembly HA contacts the pressure roller 140, and a fourth state in which the heating assembly HA is separated from the pressure roller 140. In other words, the third state contains the first state and the second state.

More specifically, during normal operations (when the operating lever 533 has not been operated), the pressing assembly 500 is in the first state in which each of the left and right cams 532 is separated from the corresponding arm member 510, as shown in FIG. 7A. At this time, each of the left and right arm members 510 urges the heating assembly HA toward the pressure roller 140, and the heating assembly HA is at its closest position relative to the pressure roller 140. When the pressing assembly 500 is in the first state, the heating assembly HA contacts the pressure roller 140 with the first pressure force, as shown in FIG. 8A.

Figure 7B:
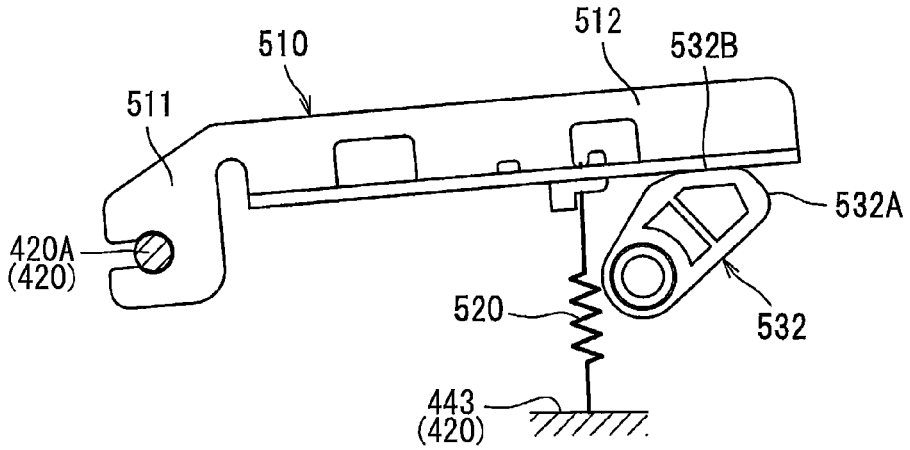
FIG. 7B is a view showing a second state of the pressing assembly.

When the operating lever 533 is rotated to switch the pressing assembly 500 to the second state shown in FIG. 7B, the release surface 532B of each of the left and right cams 532 contacts the corresponding arm member 510, and push the corresponding arm member 510 upward. Consequently, each of the left and right arm members 510 rises upward against the urging force of the corresponding helical extension spring 520. In other words, when the release surface 532B of each cam 532 pushes the corresponding arm member 510 upward, the arm member 510 is pivotally moved about the shaft part 420A such that the rear end 512 is moved upward. This reduces the amount of force that the heating assembly HA incurs from the arm member 510. Accordingly, the heating assembly HA moves upward while being guided by the first guide parts 442 and the second guide parts 443 of the first frame 400. At this time, the heating assembly HA contacts the pressure roller 140 with the second pressure force, which is smaller than the first pressure force, as illustrated in FIG. 8B.

Figure 7C:
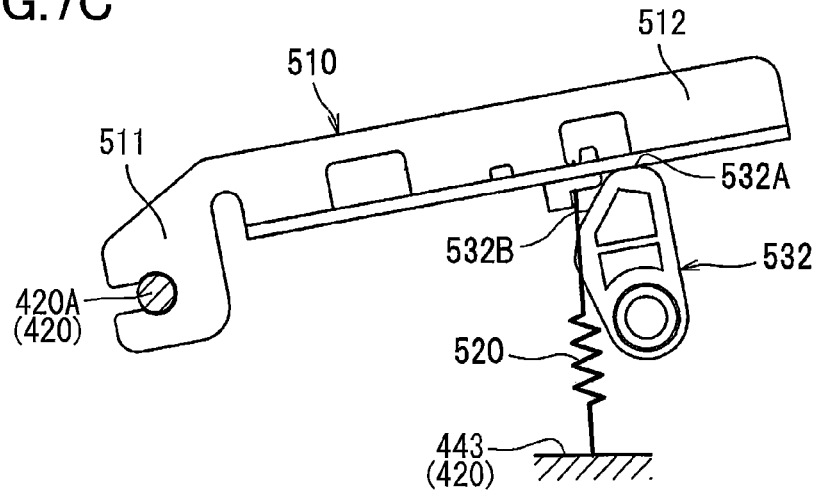
FIG. 7C is a view showing a fourth state of the pressing assembly.

If the operating lever 533 is rotated further, the pressing assembly 500 switches to the fourth state shown in FIG. 7C. In this state, the complete release surface 532A of each of the left and right cams 532 contacts the corresponding arm member 510, raising the corresponding arm member 510 further upward. Consequently, the heating assembly HA moves further upward while being guided by the first guide parts 442 and the second guide parts 443 until the heating assembly HA separates from the pressure roller 140, as shown in FIG. 8C. At this time, the heating assembly HA applies no pressure force to the pressure roller 140.

If the operating lever 533 is operated for returning the pressing assembly 500 from the fourth state to the first state, each of the left and right cams 532 separates from the corresponding arm member 510, as shown in FIG. 7A. Consequently, the heating assembly HA is brought downward by the urging force of each of the left and right helical extension springs 520 while the heating assembly HA is guided by the first guide parts 442 and the second guide parts 443. At this time, the heating assembly HA again contacts the pressure roller 140, as shown in FIG. 8A.

Next, operations and effects of the fixing device 100 having the above structure will be described.

When the pressing assembly 500 is in the first state, the heating assembly HA presses against the pressure roller 140 as shown in FIG. 5. As a consequence, the pressure roller 140 pushes the recessed parts 431 in the first frame 400 downward.

Due to the downward pressure on the recessed parts 431, the side walls 420 of the first frame 400 may be deformed, whereby the first guide parts 442 connected to the front walls 432 that define the front edges of the recessed parts 431 and the second guide parts 443 connected to the rear walls 433 that define the rear edges of the recessed parts 431 collapse inward with respect to the front-rear direction (toward the heating assembly HA).

In the present embodiment, the upper end 445B on the first restriction surface 445A, which is the surface of the first guide part 442 positioned closest in the front-rear direction to the first wall 231 (the endface 231B on the outer first rib 235A), faces the endface 231B of the first wall 231 in the front-rear direction. Hence, even if the first guide part 442 buckles inward toward the first wall 231, the first guide part 442 does not lean over the top of the first wall 231. Rather, the first restriction surface 445A contacts the endface 231B of the first wall 231, and this contact prevents further collapse of the first guide part 442.

Similarly, the upper end 447B on the second restriction surface 447A, which is the surface of the second guide part 443 positioned closest in the front-rear direction to the second wall 232 (the endface 232B on the outer second rib 236A), faces the endface 232B of the second wall 232 in the front-rear direction. Hence, even if the second guide part 443 buckles inward toward the second wall 232, the second guide part 443 does not lean over the top of the second wall 232. Rather, the second restriction surface 447A contacts the endface 232B of the second wall 232, and this contact prevents further collapse of the second guide part 443.

With this construction, the first guide parts 442 and the second guide parts 443 do not lean over the corresponding guided portions 233 of the heating assembly HA even if the first frame 400 deforms and, thus, upward movement of the heating assembly HA will not be impeded.

When the fixing device 100 is provided with the pressing assembly 500, as in the present embodiment, each helical extension spring 520 applies a force to the top edge of the corresponding second guide part 443 for pulling the second guide part 443 upward. Additionally, each helical extension spring 520 urges the rear end 512 of the corresponding arm member 510 downward, causing the front end 511 of the arm member 510 to attempt to move upward. Consequently, the force attempting to pull the arm member 510 upward acts on the portion of the corresponding first guide part 442 near the top edge thereof around which the arm member 510 is pivotally movably supported. In other words, when the pressure roller 140 pushes each recessed part 431 downward, the first guide part 442 and the second guide part 443 on either side of the recessed part 431 are pulled upward. As a result, the first frame 400 has a tendency to deform such that each first guide part 442 and each second guide part 443 collapse inward in the front-rear direction (toward the heating assembly HA).

However, as described above, the first guide parts 442 and the second guide parts 443 do not tilt over the tops of the guided parts 233 constituting the heating assembly HA, even when the side walls 420 of the first frame 400 readily deform. Hence, this construction can prevent the first frame 400 from impeding upward movement of the heating assembly HA.

In the present embodiment, when the heating assembly HA is in its closest position relative to the pressure roller 140, the upper end 445B on the first restriction surface 445A opposes the first wall 231 in the front-rear direction and the upper end 447B on the second restriction surface 447A opposes the second wall 232 in the front-rear direction. Accordingly, the above effects can be obtained regardless of the position of the heating assembly HA relative to the pressure roller 140.

Various modifications are conceivable.

In the above-described embodiment, the front-rear movement of the heating assembly HA is restricted by the first restriction walls 445 and the second restriction walls 447, which are provided in addition to the first protrusions 444 and the second protrusions 446 fitted in the first grooves 231A and the second grooves 232A, but the present invention is not limited to this configuration.

For example, forward movement of the heating assembly HA may be restricted by distal end portions (endfaces) of the first protrusions abutting inner wall portions (closed end surfaces) of the first grooves, and rearward movement of the heating assembly HA may be restricted by distal end portions (endfaces) of the second protrusions abutting inner wall portions (closed end surfaces) of the second grooves.

While the entire first frame 400 is formed integrally of molded resin in the above-described embodiment, the entire first frame 400 may be integrally formed of metal instead.

Further, it is not necessary to form the entire first frame 400 of the same material. The first restriction walls 445 and the second restriction walls 447 may be integrally coupled to separate parts. For example, the first restriction walls 445 and the second restriction walls 447 may be formed of resin, while the members of the first frame 400 other than the first restriction walls 445 and the second restriction walls 447 may be formed of metal. In this case, the first frame 400 could be configured by coupling the first restriction walls 445 and the second restriction walls 447 to the other members of the first frame 400.

Alternatively, the first restriction wall 445 and the first protrusion 444 may be integrally molded of resin to constitute the first guide part 442, while the second restriction wall 447 and the second protrusion 446 are integrally molded of resin in the same way to constitute the second guide part 443. The other members of the first frame 400 other than the first guide parts 442 and the second guide parts 443 are then formed of metal, and the first frame 400 is constituted by integrally coupling the first guide parts 442 and the second guide parts 443 to the other members of the first frame 400.

In the above-described embodiment, the nip plate 130 formed of metal serves as an example of a nip member, and the heating assembly HA is provided with the halogen lamp 120 for heating the nip plate 130, but the present invention is not limited to this configuration. For example, the nip member may be a ceramic heater formed in a plate shape. In this case, the halogen lamp 120 or other heating body needs not be provided separately from the nip member.

While the present invention has been described in detail with reference to the embodiments thereof, it would be apparent to those skilled in the art that various changes and modifications may be made therein without departing from the spirit of the present invention.

What is claimed is:

1. A fixing device comprising:

a roller having an axis extending in a first direction, the roller configured to rotate about the axis and having end portions in the first direction;

a heating assembly facing the roller in a second direction perpendicular to the first direction, the heating assembly being configured to provide a nip region in cooperation with the roller, the heating assembly including a guided portion having a first surface and a second surface positioned opposite to the first surface in a third direction perpendicular to the first direction and the second direction, the first surface being formed with a first groove recessed into the first surface toward the second surface, the second surface being formed with a second groove recessed into the second surface toward the first surface;

a pressing assembly configured to urge the heating assembly toward the roller; and a frame configured to support the end portions of the roller and configured to movably support the heating assembly in the second direction, the frame having a first wall and a second wall facing the first wall in the third direction, the frame including:

a recessed portion defined by the first wall and the second wall and having an opening facing the heating assembly, the recessed portion being configured to support the end portions of the roller;

a first guide portion configured to guide movement of the heating assembly and connected to the first wall, the first guide portion having a first protrusion and a first restriction wall, the first protrusion protruding toward the first groove and configured to fit into the first groove, the first protrusion having a surface facing in the first direction, the first restriction wall protruding from the surface facing in the first direction of the first protrusion and being positioned outside the first groove, the first restriction wall having a first restriction surface that is configured to face the first surface in the third direction to restrict the guided portion from moving in the third direction, the first restriction surface having a farthest end portion positioned farthest from the roller in the second direction, the farthest end portion of the first restriction surface facing the first surface in the third direction when the heating assembly is at its closest position to the roller; and a second guide portion configured to guide movement of the heating assembly and connected to the second wall, the guided portion being configured to be interposed between the first guide portion and the second guide portion in the third direction, the second guide portion being positioned opposite to the first guide portion in the third direction, the second guide portion having a second protrusion and a second restriction wall, the second protrusion protruding toward the second groove and configured to fit into the second groove, the second protrusion having a surface facing in the first direction, the second restriction wall protruding from the surface facing in the first direction of the second protrusion and being positioned outside the second groove, the second restriction wall having a second restriction surface that is configured to face the second surface in the third direction to restrict the guided portion from moving in the third direction, the second restriction surface having a farthest end portion positioned farthest from the roller in the second direction, the farthest end portion of the second restriction surface facing the second surface in the third direction when the heating assembly is at its closest position to the roller, wherein the first surface of the guided portion of the heating assembly has a first portion facing the farthest end portion of the first restriction surface, the first portion extending beyond the farthest end portion of the first restriction surface in a direction away from the roller when the heating assembly is at its closest position to the roller, and wherein the second surface of the guided portion of the heating assembly has a second portion facing the farthest end portion of the second restriction surface, the second portion extending beyond the farthest end portion of the second restriction surface in a direction away from the roller when the heating assembly is at its closest position to the roller.

2. The fixing device as claimed in claim 1, wherein the frame is made from a resin.

3. The fixing device as claimed in claim 1, wherein the pressing assembly is configured to be switched between a first state in which the heating assembly contacts the roller with a first pressure force, and a second state in which the heating assembly contacts the roller with a second pressure force smaller than the first pressure force.

4. The fixing device as claimed in claim 3, wherein the first state provides the closest position of the heating assembly to the roller.

5. The fixing device as claimed in claim 1, wherein the pressing assembly is configured to be switched between a third state in which the heating assembly contacts the roller, and a fourth state in which the heating assembly separates from the roller.

6. The fixing device as claimed in claim 1, wherein the heating assembly includes an endless belt having an inner peripheral surface defining an internal space, and a nip member disposed in the internal space and configured to nip the endless belt in cooperation with the roller.

7. The fixing device as claimed in claim 1, wherein the frame comprises a plurality of members each made from a material different from one another, the plurality of members being coupled to one another to constitute the frame.

8. The fixing device as claimed in claim 1, wherein the pressing assembly comprises:

an arm member having a first end portion pivotably supported by the first guide portion of the frame and a second end portion opposite to the first end portion; and a spring connecting the second end portion of the arm member and the second guide portion of the frame.

9. The fixing device as claimed in claim 8, wherein the first guide portion has a shaft part, and the first end portion of the arm member has an opening portion where the shaft part is inserted.

10. A fixing device comprising:

a roller having an axis extending in a first direction, the roller configured to rotate about the axis and having end portions in the first direction;

a heating assembly facing the roller in a second direction perpendicular to the first direction, the heating assembly being configured to provide a nip region in cooperation with the roller, the heating assembly including a guided portion having a surface referred to as a third surface and another surface referred to as a fourth surface positioned opposite to the third surface, the third surface being formed with a first groove recessed toward the fourth surface, the fourth surface being formed with a second groove recessed toward the third surface;

a frame configured to support the end portions of the roller and configured to movably support the heating assembly in the second direction, the frame having a first wall and a second wall facing the first wall, the frame including:

a recessed portion defined by the first wall and the second wall and having an opening facing the heating assembly, the recessed portion being configured to support the end portions of the roller, the recessed portion having a closest end portion closest to the heating assembly in the second direction;

a first guide portion configured to guide movement of the heating assembly and connected to the first wall, the first guide portion having a first protrusion protruding toward the first groove, the first protrusion being configured to fit into the first groove, the first protrusion having a first end face, the first end face having a farthest end portion positioned farthest from the roller in the second direction, the first guide portion having a support portion; and a second guide portion configured to guide movement of the heating assembly and connected to the second wall, the guided portion being configured to be interposed between the first guide portion and the second guide portion, the second guide portion being positioned opposite to the first guide portion, the second guide portion having a second protrusion protruding toward the second groove, the second protrusion being configured to fit into the second groove, the second protrusion having a second end face, the second end face having a farthest end portion positioned farthest from the roller in the second direction, the second guide portion having an engagement portion; and a pressing assembly configured to urge the heating assembly toward the roller, the pressing assembly comprising:

an arm member having a first end portion and a second end portion opposite to the first end portion of the arm member, the first end portion of the arm member being pivotally supported by the support portion of the first guide portion of the frame;

a spring having a first end portion and a second end portion opposite to the first end portion of the spring, the first end portion of the spring engaging with the second end portion of the arm member, the second end portion of the spring engaging with the engagement portion of the second guide portion of the frame; and a pressing surface configured to press the heating assembly toward the roller, wherein the first groove of the guided portion of the heating assembly has a first portion facing the farthest end portion of the first end face, the first portion extending beyond the farthest end portion of the first end face in a direction away from the roller when the heating assembly is in its closest position to the roller, and wherein the second groove of the guided portion of the heating assembly has a second portion facing the farthest end portion of the second end face, the second portion extending beyond the farthest end portion of the second end face in a direction away from the roller when the heating assembly is in its closest position to the roller, wherein the second end portion of the arm member and the engagement portion of the second guide portion define a first distance therebetween in the second direction as viewed in the first direction and when the heating assembly is at its closest position to the roller, the second end portion of the arm member and the closest end portion of the recessed portion defining a second distance therebetween in the second direction as viewed in the first direction and when the heating assembly is at its closest position to the roller, the first distance being smaller than the second distance, and wherein the support portion of the first guide portion and the closest end portion of the recessed portion define a third distance therebetween in the second direction as viewed in the first direction, the pressing surface of the pressing assembly and the closest end portion of the recessed portion defining a fourth distance therebetween in the second direction as viewed in the first direction and when the heating assembly is at its closest position to the roller, the third distance being smaller than the fourth distance.

11. The fixing device as claimed in claim 10, wherein the frame comprises a plurality of members each made from a different material.

12. The fixing device as claimed in claim 10, wherein the first guide portion having a surface referred to as a fifth surface facing the third surface, the fifth surface having a farthest end portion positioned farthest from the roller in the second direction, wherein the second guide portion having a surface referred to as a sixth surface facing the fourth surface, the sixth surface having a farthest end portion positioned farthest from the roller in the second direction, wherein the third surface of the guided portion of the heating assembly has a first portion facing the farthest end portion of the fifth surface when the heating assembly is at its closest position to the roller, the first portion of the third surface extends beyond the farthest end portion of the fifth surface in a direction away from the roller when the heating assembly is at its closest position to the roller, and wherein the fourth surface of the guided portion of the heating assembly has a second portion facing the farthest end portion of the sixth surface when the heating assembly is at its closest position to the roller, and the second portion of the fourth surface extends beyond the farthest end portion of the sixth surface in a direction away from the roller when the heating assembly is at its closest position to the roller.

13. A fixing device comprising:

a roller having an axis extending in a first direction, the roller configured to rotate about the axis and having end portions in the first direction;

a heating assembly facing the roller in a second direction perpendicular to the first direction, the heating assembly being configured to provide a nip region in cooperation with the roller, the heating assembly including a guided portion having a first surface and a second surface positioned opposite to the first surface;

a frame configured to support the end portions of the roller and configured to movably support the heating assembly in the second direction, the frame having a first wall and a second wall facing the first wall, the frame including:

a recessed portion defined by the first wall and the second wall and configured to support the end portions of the roller, the recessed portion having a closest end portion closest to the heating assembly in the second direction;

a first guide portion configured to guide movement of the heating assembly and connected to the first wall, the first guide portion having a surface referred to as a fifth surface facing the first surface, the fifth surface having a farthest end portion positioned farthest from the roller in the second direction, the first guide portion having a support portion; and a second guide portion configured to guide movement of the heating assembly and connected to the second wall, the guided portion being configured to be interposed between the first guide portion and the second guide portion, the second guide portion having a surface referred to as a sixth surface facing the second surface, the sixth surface having a farthest end portion positioned farthest from the roller in the second direction the second guide portion having an engagement portion; and a pressing assembly configured to urge the heating assembly toward the roller, the pressing assembly comprising:

an arm member having a first end portion and a second end portion opposite to the first end portion of the arm member, the first end portion of the arm member being pivotally supported by the support portion of the first guide portion of the frame;

a spring having a first end portion and a second end portion opposite to the first end portion of the spring, the first end portion of the spring engaging with the second end portion of the arm member, the second end portion of the spring engaging with the engagement portion of the second guide portion of the frame; and a pressing surface configured to press the heating assembly toward the roller, wherein the first surface of the guided portion of the heating assembly has a first portion facing the farthest end portion of the fifth surface when the heating assembly is at its closest position to the roller, wherein the second surface of the guided portion of the heating assembly has a second portion facing the farthest end portion of the sixth surface when the heating assembly is at its closest position to the roller, and wherein the second end portion of the arm member and the engagement portion of the second guide portion define a first distance therebetween in the second direction as viewed in the first direction and when the heating assembly is at its closest position to the roller, the second end portion of the arm member and the closest end portion of the recessed portion defining a second distance therebetween in the second direction as viewed in the first direction and when the heating assembly is at its closest position to the roller, the first distance being smaller than the second distance.

14. The fixing device as claimed in claim 13, wherein the frame comprises a plurality of members each made from a different material different.

15. The fixing device as claimed in claim 13, wherein the frame includes a resin frame.

16. The fixing device as claimed in claim 15, wherein the first portion of the first surface extends beyond the farthest end portion of the fifth surface in a direction away from the roller when the heating assembly is at its closest portion to the roller, and wherein the second portion of the second surface extends beyond the farthest end portion of the sixth surface in a direction away from the roller when the heating assembly is at its closest position to the roller.

17. The fixing device as claimed in claim 13, wherein the first portion of the first surface extends beyond the farthest end portion of the fifth surface in a direction away from the roller when the heating assembly is at its closest position to the roller, and wherein the second portion of the second surface extends beyond the farthest end portion of the sixth surface in a direction away from the roller when the heating assembly is at its closest position to the roller.

* * * * *